US010953901B2

(12) United States Patent
Tokumaru

(10) Patent No.: US 10,953,901 B2
(45) Date of Patent: Mar. 23, 2021

(54) TRAIN OPERATION CONTROL SYSTEM AND TRAIN OPERATION CONTROL METHOD

(71) Applicant: MITSUBISHI ELECTRIC CORPORATION, Tokyo (JP)

(72) Inventor: Makoto Tokumaru, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 247 days.

(21) Appl. No.: 16/073,470

(22) PCT Filed: Mar. 29, 2016

(86) PCT No.: PCT/JP2016/060221

§ 371 (c)(1),
(2) Date: Jul. 27, 2018

(87) PCT Pub. No.: WO2017/168585

PCT Pub. Date: Oct. 5, 2017

(65) Prior Publication Data

US 2019/0039634 A1 Feb. 7, 2019

(51) Int. Cl.
*B61L 27/00* (2006.01)
*G08G 1/01* (2006.01)
(Continued)

(52) U.S. Cl.
CPC ..... *B61L 27/0016* (2013.01); *B61L 25/025* (2013.01); *B61L 27/0027* (2013.01);
(Continued)

(58) Field of Classification Search
CPC ..... B61L 27/0016; B61L 27/0027; B61L 27/0077; B61L 25/025; G06Q 50/30; G08G 1/01
See application file for complete search history.

(56) References Cited

U.S. PATENT DOCUMENTS

2004/0138805 A1* 7/2004 Feray ..... G08G 1/123 701/117
2014/0229041 A1* 8/2014 Egler ..... B61L 15/00 701/19
(Continued)

FOREIGN PATENT DOCUMENTS

DE 10 2011 078 447 A1 8/2012
EP 2 541 506 A1 1/2013
(Continued)

OTHER PUBLICATIONS

Extended European Search Report dated Apr. 1, 2019, issued by the European Patent Office in corresponding European Application No. 16896805.5. (11 pages).
(Continued)

*Primary Examiner* — Jason C Smith
(74) *Attorney, Agent, or Firm* — Buchanan Ingersoll & Rooney PC

(57) ABSTRACT

A train operation control system includes: a headcount estimation device that estimates the number of people in a train and the number of people on a platform by using video data outputted from a plurality of on-board cameras and a plurality of ground cameras; and a train rescheduling device that predicts a dwell time required for passengers to board and detrain from the train using the estimated headcount information estimated by the headcount estimation device and schedule information stored in an operation management device, and accordingly performs train operation rescheduling. The train operation control system can predict the dwell time accurately and accordingly perform train operation rescheduling even when the number of passengers fluctuates.

7 Claims, 8 Drawing Sheets

(51) Int. Cl.
*G06Q 50/30* (2012.01)
*B61L 25/02* (2006.01)

(52) U.S. Cl.
CPC ..... *B61L 27/0077* (2013.01); *G06Q 50/30* (2013.01); *G08G 1/01* (2013.01); *B61L 2201/00* (2013.01)

(56) References Cited

U.S. PATENT DOCUMENTS

| | | | | |
|---|---|---|---|---|
| 2016/0012297 | A1* | 1/2016 | Kanga | G06K 9/00771 382/103 |
| 2016/0142679 | A1* | 5/2016 | Miyoshi | H04N 7/181 348/159 |
| 2017/0072974 | A1* | 3/2017 | Morita | B61L 27/04 |
| 2019/0039634 | A1* | 2/2019 | Tokumaru | B61L 25/025 |

FOREIGN PATENT DOCUMENTS

| | | | |
|---|---|---|---|
| EP | 1 403 163 | B2 | 11/2016 |
| GB | 2508508 | A | 6/2014 |
| JP | 1114365 | U | 8/1989 |
| JP | 08048250 | A | 2/1996 |
| JP | 10329718 | A | 12/1998 |
| JP | 2002037076 | A | 2/2002 |
| JP | 2005271765 | A | 10/2005 |
| JP | 2010221839 | A | 10/2010 |
| JP | 2014148277 | A | 8/2014 |
| JP | 2014220859 | A | 11/2014 |
| JP | 2015182654 | A | 10/2015 |
| WO | 2006/032625 | A1 | 3/2006 |
| WO | 2013/030074 | A1 | 3/2013 |

OTHER PUBLICATIONS

Office Action dated Mar. 20, 2020, by the India Patent Office in corresponding India Patent Application No. 201847033964 and English translation of the Office Action. (6 pages).

International Search Report (PCT/ISA/210) dated Apr. 26, 2016, by the Japanese Patent Office as the International Searching Authority for International Application No. PCT/JP2016/060221.

Notification of Reasons for Refusal dated Jun. 19, 2018, by the Japanese Patent Office for Application No. 2018-507897.

NTT Technical Journal, "Advertisement effect measuring technique based on image processing—Application of people counting technique and face image processing technique", the Internet <URL: http:/ /www.ntt.cojp/journal/1301/files/jn201301061.pdf>.

Written Opinion (PCT/ISA/237) dated Apr. 26, 2016, by the Japanese Patent Office as the International Searching Authority for International Application No. PCT/JP2016/060221.

* cited by examiner

TRAIN OPERATION CONTROL SYSTEM AND TRAIN OPERATION CONTROL METHOD

FIELD

The present invention relates to a train operation control system and a train operation control method for controlling operations of two or more trains present on a railway track.

BACKGROUND

In a conventional train operation control system typified by one disclosed in Patent Literature 1, a boarding detection means assigns an individual number to a ticket and detects a boarding station of a passenger, a boarding time of the passenger, and a valid section of the ticket, while a destination station side device reads the individual number assigned to the ticket, detects the destination station and a detraining time of the passenger, and registers these detected values in a database.

On the other hand, in the conventional train operation control system typified by the one disclosed in Patent Literature 1, a schedule preparation means prepares a predicted schedule and a future control schedule in consideration of a predicted stopping time of the train according to the location of the train detected by a train location detection means. Then, a passenger count prediction means predicts the number of passengers on each of a number of trains on the railroad track for each of a plurality of stations on the basis of the boarding station of a passenger, the boarding time of a passenger, the valid section of the ticket, past data registered in the database, and the predicted schedule prepared by the schedule preparation means. Moreover, a train stopping time prediction means predicts the stopping time of the train to use it in the preparation of the predicted schedule, and a train course control means controls the course of the train according to the control schedule prepared by the train stopping time prediction means.

In preparing data of the stopping time, the train stopping time prediction means holds together, in the data, pieces of element information such as a line name, a station name, and a platform name corresponding to the stopping time. Element information difficult to get at this time is made to be held in a state with no numerical value. Then, in the step of obtaining the stopping time at the station in making a prediction about the train that operates according to the schedule, the train stopping time prediction means uses information not having the state with no numerical value from among the pieces of element information to obtain the stopping time corresponding to the pieces of element information and, when two or more data pieces exist on the corresponding stopping time, calculates an average value or a maximum value to obtain a predicted value of the stopping time at the station.

CITATION LIST

Patent Literature

Patent Literature 1: Japanese Patent Application Laid-open No. 2010-221839

Non Patent Literature

Non Patent Literature 1: NTT Technical Journal, "Advertisement effect measuring technique based on image processing—Application of people counting technique and face image processing technique", the Internet <URL: http://www.ntt.co.jp/journal/1301/files/jn201301061.pdf>

SUMMARY

Technical Problem

However, the conventional train operation control system typified by the one disclosed in Patent Literature 1 predicts the number of passengers on each train for each station on the basis of the past data registered in the database and the predicted schedule of the schedule preparation means. For this reason, a dwell time cannot be accurately predicted when the number of passengers suddenly fluctuates or is concentrated in a specific car due to a factor such as some event, bad weather, or disruption to train services.

The present invention has been made in view of the above circumstances, and an object of the present invention is to provide a train operation control system that can accurately predict the dwell time and perform train rescheduling even when the number of passengers steeply fluctuates.

Solution to Problem

In order to solve the above-mentioned problems and achieve the object, the present invention provides a train operation control system comprising: a headcount estimation device to estimate at least one of the number of people in a train and the number of people on a platform of a station, using video data outputted from a plurality of cameras; and a train rescheduling device to predict a dwell time for the train using estimated headcount information estimated by the headcount estimation device and schedule information, and accordingly perform train rescheduling.

Advantageous Effects of Invention

The present invention can obtain an advantageous effect of being able to accurately predict the dwell time and satisfactorily perform train operation rescheduling even when the number of passengers steeply fluctuates.

DESCRIPTION OF EMBODIMENT

A train operation control system and a train operation control method according to an embodiment of the present invention will now be described in detail with reference to the drawings. Note that the present invention is not necessarily limited by the embodiment.

Embodiment

Figure 1:
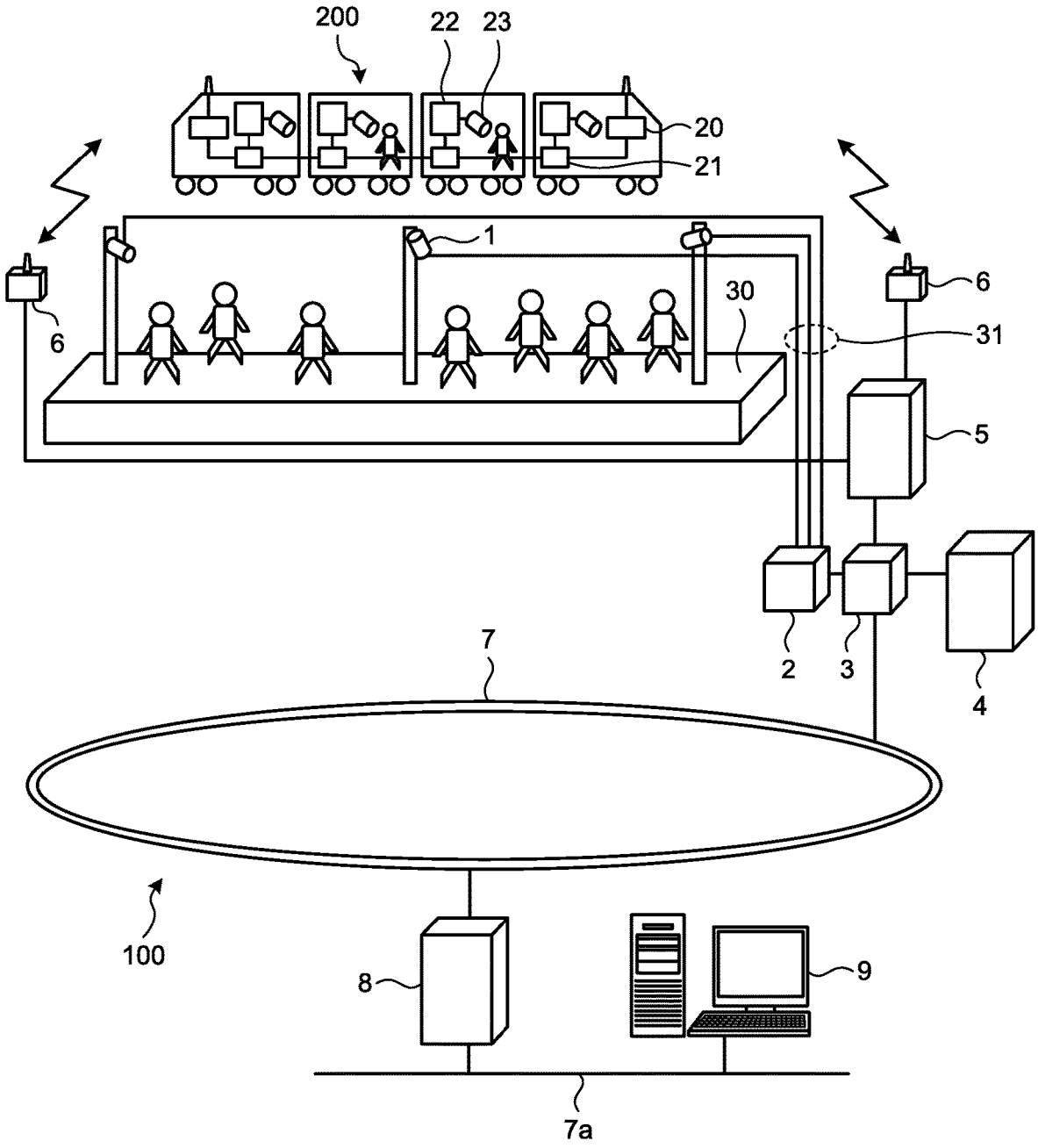
FIG. 1 is a diagram illustrating constituent devices of a train operation control system according to an embodiment of the present invention and on-board devices.

FIG. 1 is a diagram illustrating constituent devices of a train operation control system and on-board devices according to an embodiment of the present invention.

A train operation control system 100 includes two or more ground cameras 1, a headcount estimation device 2, a transmission interface unit 3, a base device 4, a ground transmission device 5, a ground radio device 6, a transmission line 7, an operation management device 8 that manages an operation of a train, and a train rescheduling device 9 that performs train rescheduling. The train rescheduling refers to changing a train operation plan according to various factors including a failure in a train car and bad weather.

The base device 4 and the ground transmission device 5 are connected to the transmission line 7 via the transmission interface unit 3.

The ground radio device 6 is connected to the ground transmission device 5. The plurality of ground cameras 1 is connected to the headcount estimation device 2 via transmission lines 31.

The operation management device 8 and the train rescheduling device 9 are connected to the transmission interface unit 3 via the transmission line 7.

The ground cameras 1 are each an imager installed for a station platform 30 and is, for example, a surveillance camera that monitors the state of the platform 30.

The ground camera 1 may be an existing camera installed at the platform 30 or a camera newly installed for use in the train operation control system 100.

In an example of FIG. 1, three ground cameras 1 are installed along a longitudinal direction of the platform 30.

The ground cameras 1 installed for the platform 30 are not limited to three cameras, but more than three cameras may be installed so as to, for example, make it possible to shoot video of passengers boarding on each of cars constituting the train 200 and passengers detraining from each of the cars without omission.

The headcount estimation device 2 estimates the number of people in the range captured by each of the ground cameras 1 on the basis of video data obtained by each of the ground cameras 1, and transmits estimated headcount information to the transmission interface unit 3.

Note that the video data is transmitted from the ground cameras 1 to the headcount estimation device 2 via the transmission lines 31 on the ground side as in the example illustrated in the figure.

Specific examples of the method of estimating the number of people in the headcount estimation device 2 include one disclosed in the above-mentioned Non Patent Literature.

The Non Patent Literature discloses a method of estimating a total head count in an image on the basis of the area on the image by modeling a positional relationship among a camera, the floor, and a person and a geometric relationship between these and the image.

The base device 4 receives train location information transmitted from trains, tracks the locations of a plurality of trains, and calculates a stopping limit of each train in order for the trains to be able to travel with securing a safe headway.

Note that the train location information transmitted from the trains is calculated on the basis of information obtained by a tacho-generator (not illustrated) and a transponder (not illustrated) mounted on the train 200.

The train location information having been calculated is then transmitted from an on-board radio device 20 mounted on the train 200 to the ground radio device 6, and transmitted from the ground radio device 6 to the base device 4 via the ground transmission device 5 and the transmission interface unit 3.

The operation management device 8 receives train presence information outputted from the base device 4 via the transmission line 7 and, on the basis of the train presence information, tracks the locations of the plurality of trains by continuously monitoring the locations of the trains, IDs held by the trains, and train numbers on the schedule always in association with one another.

The operation management device 8 further controls devices controlling the course of the train, such as a railroad signal 11 and a railroad switch 13 on the basis of the locations of the trains, the current time, and the schedule.

The train rescheduling device 9 receives the train presence information outputted from the operation management device 8 via a transmission line 7*a*.

The train rescheduling device 9 also receives estimated headcount information estimated by a headcount estimation device 22 in the train 200 and the estimated headcount information estimated by the headcount estimation device 2.

On the basis of the estimated headcount information and the train presence information, the train rescheduling device 9 makes a train operation prediction and a dwell time prediction to generate a train rescheduling plan on the basis of a result of the dwell time prediction.

Note that this example is premised on setting the headcount estimation device 2, the transmission interface unit 3, the base device 4, and the ground transmission device 5 for each station.

The train 200 includes the on-board radio device 20, an on-board transmission device 21, and an on-board camera 23.

The on-board camera 23 is an imager mounted in each car of the train 200 and is a surveillance camera that monitors the state in each car of the train 200. In FIG. 1, the on-board camera 23 is installed in each car of the train 200, and so four on-board cameras 23 are installed in the train 200.

The on-board cameras 23 installed in the train 200 are not limited to four cameras, but a camera may be set up to correspond to a boarding/detraining door owned by each of cars constituting the train 200, for example.

The headcount estimation device 22 estimates the number of people in the range captured by each of the on-board cameras 23 on the basis of video data obtained by the on-board cameras 23 in the train 200, and transmits the estimated headcount information to the on-board transmission device 21.

The on-board radio device 20 is a wireless communication device that performs transmission and reception of various kinds of information with the ground radio device 6.

The on-board radio device 20 receives the estimated headcount information via the on-board transmission device 21 and transmits the information to the ground radio device 6.

The estimated headcount information obtained on the side of the train 200, which has been received by the ground radio device 6, is transmitted to the train rescheduling device 9 via the ground transmission device 5, the transmission interface unit 3, the transmission line 7, the operation management device 8, and the transmission line 7*a*.

Figure 2:
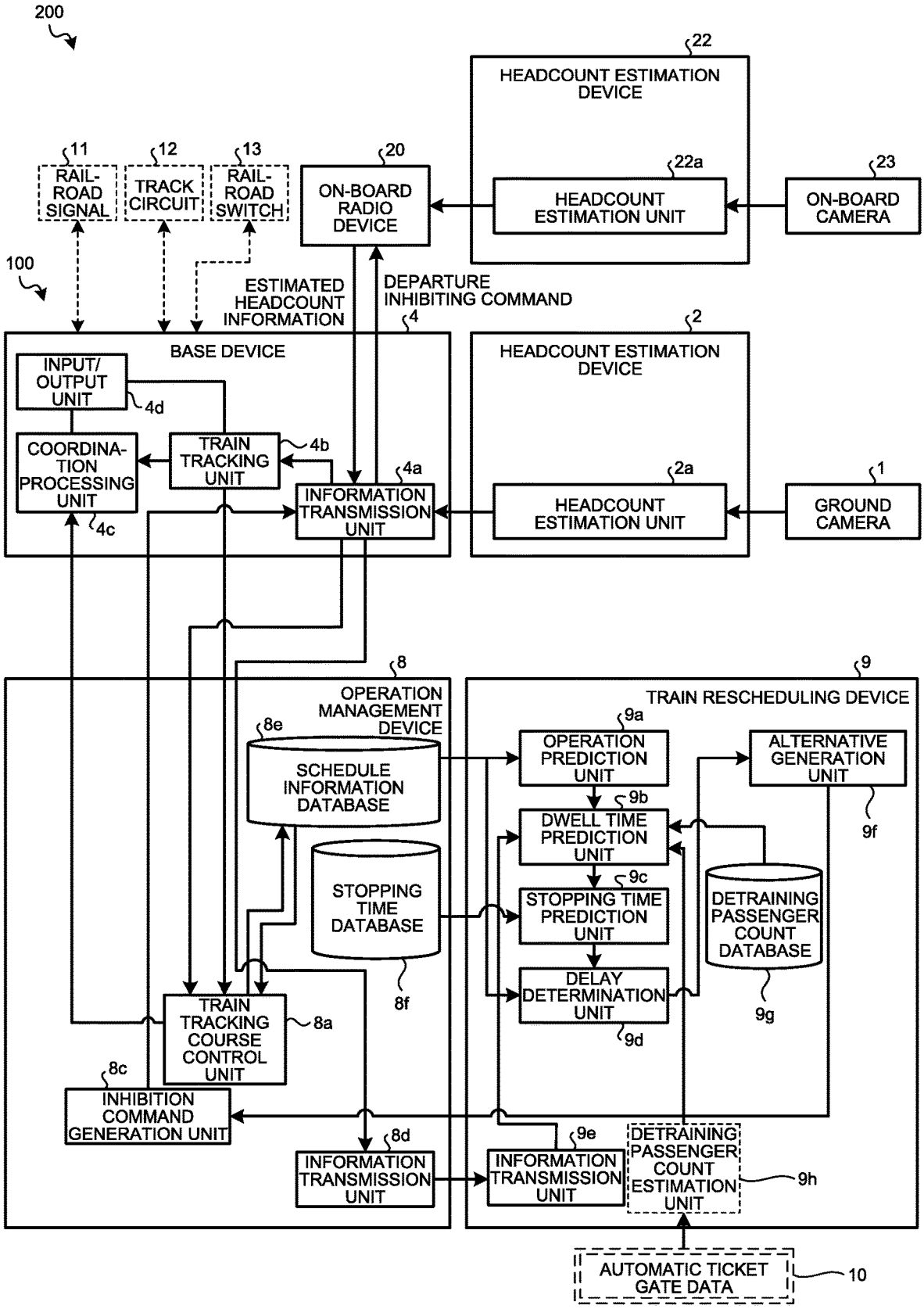
FIG. 2 is a functional block diagram of a train and the train operation control system illustrated in FIG. 1.

FIG. 2 is a functional block diagram of the train and the train operation control system illustrated in FIG. 1.

The headcount estimation device 2 includes a headcount estimation unit 2*a*. The headcount estimation unit 2*a* estimates the number of people in the range captured by each of the ground cameras 1 on the basis of the video data obtained by each of the ground cameras 1, and transmits the resultant estimated headcount information to the on-board radio device 20.

The headcount estimation device 22 includes a headcount estimation unit 22*a*. The headcount estimation unit 22*a* estimates the number of people in a car for each car on the basis of the video data transmitted from the on-board cameras 23, and transmits the estimated headcount information to the on-board radio device 20.

The base device 4 includes an information transmission unit 4*a*, a train tracking unit 4*b*, a coordination processing unit 4*c*, and an input/output unit 4*d*. The input/output unit 4*d* is connected to the train tracking unit 4*b* and the coordination processing unit 4*c*, while the railroad signal 11, a track circuit 12, and the railroad switch 13 are connected to the input/output unit 4*d*.

The information transmission unit 4*a* transmits, to the operation management device 8, the estimated headcount information transmitted from the on-board radio device 20 and the estimated headcount information transmitted from the headcount estimation device 2.

The information transmission unit 4*a* also transmits a departure inhibiting command transmitted from the operation management device 8 to the on-board radio device 20.

The train tracking unit 4*b* receives the train location information and the ID held by the train 200, transmitted from the train 200, via the information transmission unit 4*a*, and manages and updates the train location information and the ID in association with each other. In a case of a signal system having the track circuit 12, the train tracking unit 4*b* collects state information of the track circuit 12 and manages the track circuit 12 in a dropped state and the ID held by the train 200 in association with each other.

The train tracking unit 4*b* outputs the information as train tracking information to the operation management device 8.

The coordination processing unit 4*c* receives control information outputted from the operation management device 8, and controls the operation of a field device according to a preset coordination condition. The control information for controlling the operation of the field device is transmitted to the railroad signal 11 and the railroad switch 13 via the input/output unit 4*d*.

The coordination processing unit 4*c* automatically controls the operation of the field device under the coordination condition and constructs a course of the train such that each train can travel while securing a safe headway.

The operation management device 8 includes a train tracking course control unit 8*a*, an inhibition command generation unit 8*c*, an information transmission unit 8*d*, a schedule information database 8*e*, and a stopping time database 8*f*.

The schedule information database 8*e* stores therein an operating schedule of trains. The operating schedule includes a departure time and an arrival time at each station, for example.

In the stopping time database 8*f*, a planned stopping time of a train at each station is recorded.

On the basis of the train tracking information transmitted from the information transmission unit 4*a* of the base device 4, the train tracking course control unit 8*a* refers to the schedule information recorded in the schedule information database 8*e* and identifies the position in an approach sequence of each train approaching each station.

The train tracking course control unit 8*a* also identifies a position in a departing sequence of each train departing from each station, generates control information for controlling the operation of the field device in accordance with the identified position of the train, and outputs the information to the base device 4.

The information transmission unit 8*d* transmits the estimated headcount information transmitted from the base device 4 to the train rescheduling device 9. The estimated headcount information includes the estimated headcount information estimated by the headcount estimation device 22 in the train 200 and the estimated headcount information estimated by the headcount estimation device 2 on the ground side.

The train rescheduling device 9 includes an operation prediction unit 9*a*, a dwell time prediction unit 9*b*, a stopping time prediction unit 9*c*, a delay determination unit 9*d*, an information transmission unit 9*e*, an alternative generation unit 9*f*, a detraining passenger count database 9*g*, and a detraining passenger count estimation unit 9*h*.

The information transmission unit 9*e* receives the estimated headcount information transmitted from the operation management device 8, and outputs the information to the dwell time prediction unit 9*b*.

In the detraining passenger count database 9*g*, information on the number of detraining passengers for each station, the information being generated based on past traffic survey data.

The detraining passenger count estimation unit 9*h* takes in automatic ticket gate data 10 online and estimates the number of passengers detraining for each car at a corresponding station on the basis of a destination recorded on a commuter pass or ticket and the time at which the commuter pass or ticket passes through the ticket gate.

On the basis of the schedule information in the schedule information database 8*e*, the operation prediction unit 9*a* sequentially predicts the operation of traveling between stations of each of a plurality of trains traveling on the same route in the order from the first train.

The dwell time prediction unit 9*b* predicts a required dwell time for each car of a train stopped at a station. The required dwell time is predicted by using the estimated headcount information transmitted from the information transmission unit 9*e* and the past detraining passenger count recorded in the detraining passenger count database 9*g*.

The required dwell time for each car can be predicted by the following method.

(1) The headcount estimation device 2 estimates the number of passengers N on a platform using the cameras at the platform side. The number of passengers N is the number of passengers planning to board a train among passengers using the train, and is estimated car by car of the train. The number of passengers N estimated is transmitted to the train rescheduling device 9 as the estimated headcount information.

(2) The headcount estimation device 22 estimates the number of passengers M on board using the on-board side cameras. The number of passengers M may be estimated car by car, or in units of the boarding/detraining door installed in each car. The number of passengers M estimated is transmitted to the train rescheduling device 9 as the estimated headcount information.

(3) Using a detraining ratio D and the number of passengers M for each station, a predicted detraining passenger count L at a corresponding station is calculated by L=D×M. The detraining ratio D is derived from the detraining passenger count database 9*g* for each station, the database being created on the basis of the traffic survey data.

(4) A required detraining time Ta is calculated by Ta=L×M×TA. In the expression, "TA" is a weighting factor derived from the number of people detraining from the train, the number of passengers in the car, and actual measurement of the required detraining time in that case.

(5) A required boarding time Tb is calculated by Tb=N×M2×TB. In the expression, "M2" is a value obtained by subtracting the predicted detraining passenger count from the number of passengers M. Also in the expression, "TB" is a weighting factor derived from the number of boarding passengers, the number of passengers in the car, and actual measurement of the required boarding time in that case.

(6) A required dwell time Tc for the corresponding car in this case is obtained by Tc=(D×M×M×TA)+(N×M2×TB).

Note that the required detraining time Ta may be calculated using the detraining passenger count estimated by the detraining passenger count estimation unit 9*h*.

That is, instead of the above-mentioned predicted detraining passenger count L, a detraining passenger count L' estimated by the detraining passenger count estimation unit 9*h* is used to calculate a required detraining time Ta' by Ta'=L'×M×TA. By doing so, the required detraining time can be predicted more accurately.

The stopping time prediction unit 9*c* calculates a stopping time T1 from the required dwell time predicted by the dwell time prediction unit 9*b*.

Specifically, the stopping time prediction unit 9*c* selects the longest time from among the required dwell times for the cars of a preceding train predicted by the dwell time prediction unit 9*b*, and compares the required dwell time selected to the planned stopping time recorded in the stopping time database 8*f*.

The stopping time prediction unit 9*c* adopts the planned stopping time as the stopping time T1 when the required dwell time selected is shorter than the planned stopping time. Alternatively, the required dwell time selected is adopted as the stopping time T1 when the required dwell time selected is longer than the planned stopping time.

The delay determination unit 9*d* first obtains a predicted arrival time at which a train arrives at a next station on the basis of the stopping time predicted by the stopping time prediction unit 9*c*.

Next, the delay determination unit 9*d* obtains a time difference T3 that is a difference between the predicted arrival time and a planned arrival time at which the train arrives at the next station. The planned arrival time can be obtained from the schedule information recorded in the schedule information database 8*e*.

The delay determination unit 9*d* further determines whether or not the time difference T3 is larger than or equal to a threshold TS. The threshold TS is set in advance in the delay determination unit 9*d*.

When the time difference T3 is larger than or equal to the threshold TS, the delay determination unit 9*d* determines that delaying the departure time of a succeeding train at a station A, described later, can advance the arrival time of the succeeding train at a station B. Such a determination result will be hereinafter referred to as a determination A.

On the other hand, when the time difference T3 is smaller than the threshold TS, the delay determination unit 9*d* determines that stopping the succeeding train at the station A, described later, for the planned stopping time T2 can advance the arrival time of the succeeding train at the station B. Such a determination result will be hereinafter referred to as a determination B.

On the basis of the determination result of the delay determination unit 9*d*, the alternative generation unit 9*f* generates an alternative for inhibiting the departure of the succeeding train from the station A.

In the case where the determination A is made by the delay determination unit 9*d*, the alternative generation unit 9*f* generates a stopping time T4 instead of the planned stopping time T2 as the stopping time at the station A. That is, an alternative to the schedule is generated.

The stopping time T4 is obtained by T4=T3/X. The factor X is a value obtained by taking into consideration a delay in the arrival time of the succeeding train at the station B when the succeeding train temporarily stops just before the station B and then starts power running again.

Then, the operation prediction unit 9*a* predicts the operation of the succeeding train from the station B to the station A with the alternative generated by the alternative generation unit 9*f*, or with the altered stopping time T4. The operation is predicted on the basis of information pieces such as route database, car database, and the location of the preceding train on the railroad.

When the predicted arrival time at the station B is improved as a result of the operation prediction, the alternative generation unit 9*f* generates the stopping time T4 instead of the planned stopping time T2 as the stopping time at the station A for the operation management device 8. What is generated herein may be any information for inhibiting the operation loyal to the planned schedule and is made to contain some information for delaying the departure time.

Upon receiving the information, the inhibition command generation unit 8*c* generates an inhibition command indicating inhibition of the departure and also generates message information "Leave a station XX seconds later" indicating that the departure time at the station B is delayed to the stopping time T4.

The inhibition command and the message information are transmitted to a train information management device in the train 200 via the information transmission unit 4*a*. The train information management device transmits the received message information to an indicator installed in the motorman's cab.

An example of the operation of the train operation control system 100 according to the embodiment will be described with reference to FIGS. 3 to 5.

Figure 3:
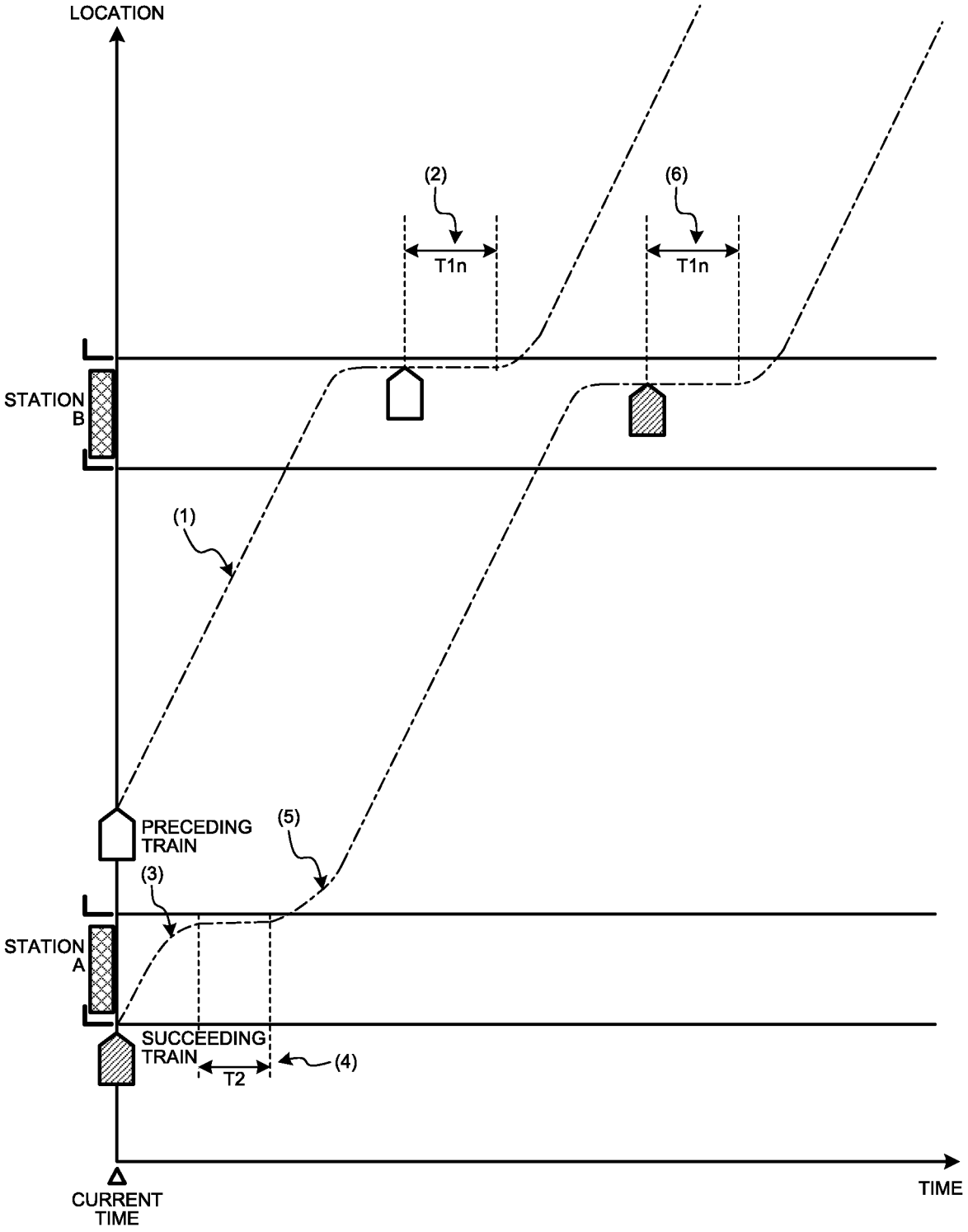
FIG. 3 is a diagram illustrating an operating state when each train is operated on a regular schedule by the train operation control system according to the embodiment of the present invention.

FIG. 3 is a diagram illustrating an operating state when each train is operated on a regular schedule by the train operation control system according to the embodiment of the present invention.

Figure 4:
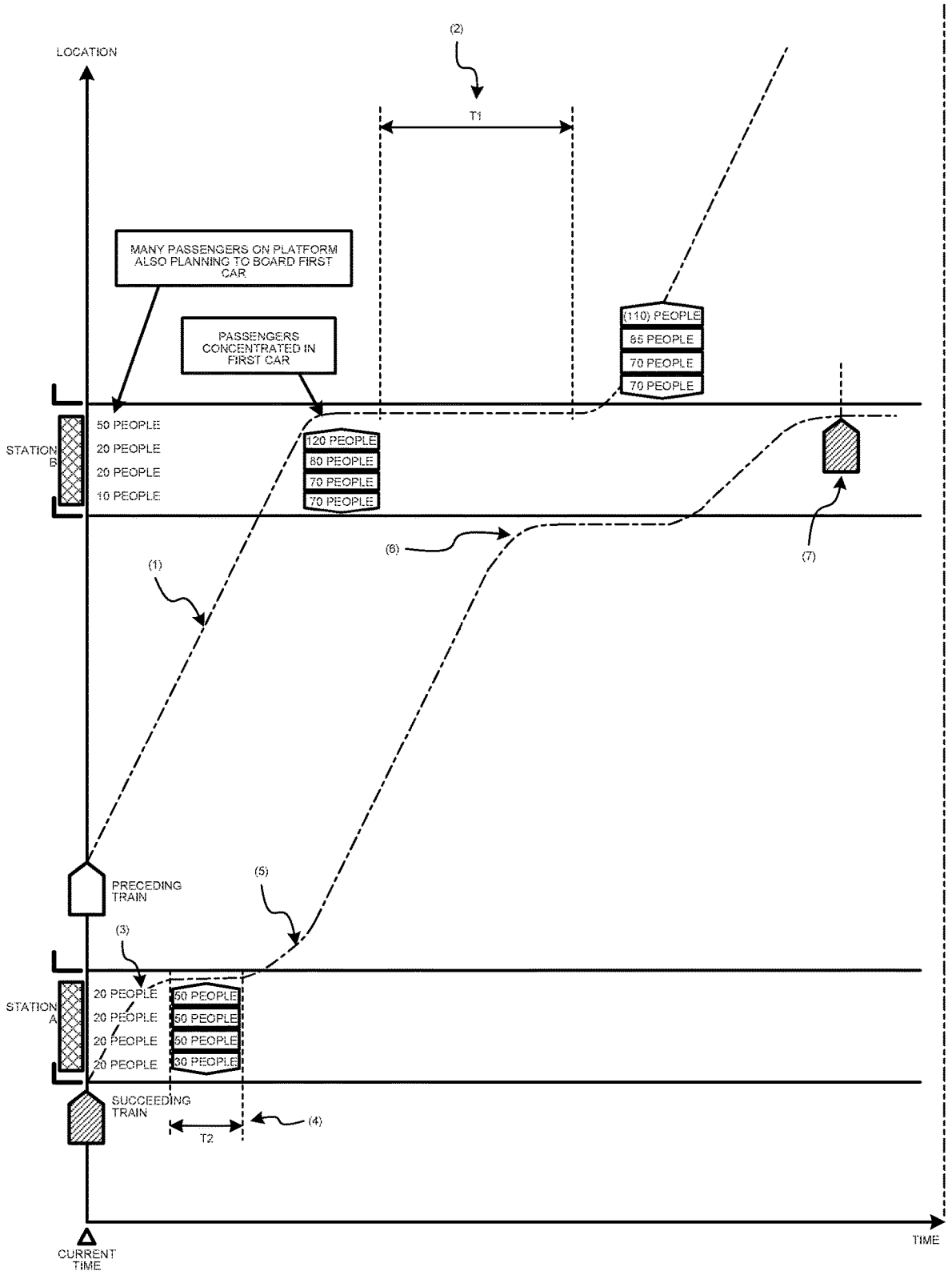
FIG. 4 is a diagram illustrating an operating state in a case where a stopping time of a succeeding train is not changed when a stopping time of a preceding train illustrated in FIG. 3 is delayed.

FIG. 4 is a diagram illustrating the operating state in a case where the stopping time of a succeeding train is not changed when the stopping time of a preceding train illustrated in FIG. 3 is delayed.

Figure 5:
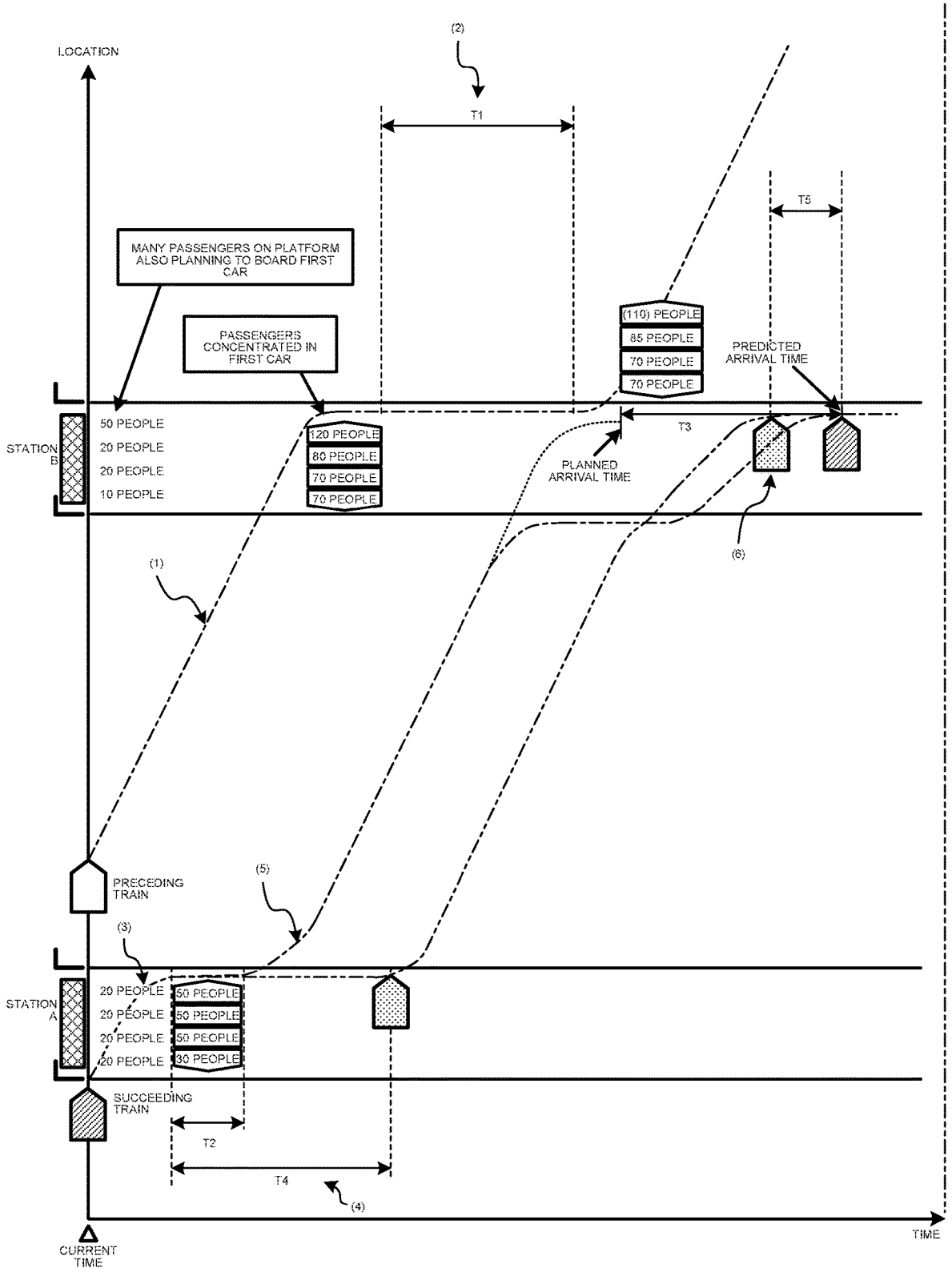
FIG. 5 is a diagram illustrating an operating state in a case where the stopping time of the succeeding train is changed when the stopping time of the preceding train illustrated in FIG. 3 is delayed.

FIG. 5 is a diagram illustrating the operating state in a case where the stopping time of the succeeding train is changed when the stopping time of the preceding train illustrated in FIG. 3 is delayed.

In each of FIGS. 3 to 5, the vertical axis indicates the location of the train and the horizontal axis indicates time.

In FIG. 3, the train operation control system performs the following operation.

(1) The operation is predicted from the departure of the preceding train at the station A to the arrival thereof at the station B on the basis of the route database, the car database, and the location on the railroad of the preceding train not illustrated.

(2) Time T1*n* is used as the planned stopping time of the preceding train arriving at the station B. The planned stopping time T1*n* is used in a situation where, for example, passengers are not concentrated at a specific place on the platform of the station B, or passengers do not crowd into a specific car of the preceding train.

(3) The operation is predicted up to the arrival of the succeeding train at the station A on the basis of the route database, the car database, and the location on the railroad of the preceding train.

(4) Time T2 is used as the planned stopping time of the succeeding train arriving at the station A.

(5) The operation of the succeeding train stopped for the planned stopping time T2 is predicted.

(6) Time T1*n* is used as the planned stopping time of the succeeding train arriving at the station B.

In FIG. 4, the train operation control system performs the following operation.

(1) The operation is predicted from the departure of the preceding train at the station A to the arrival thereof at the station B on the basis of the route database, the car database, and the location on the railroad of the preceding train not illustrated.

FIG. 4 illustrates the example in which passengers planning to board the preceding train are waiting on the platform of the station B, where the number of the passengers on the platform is assumed to be 50 people, 20 people, 20 people, and 10 people in order from a lead car in the case where the preceding train is a train made up of four cars.

Moreover, the number of passengers in the cars of the preceding train arriving at the station B is assumed to be 120 people, 80 people, 70 people, and 70 people in order from a lead car. The passengers are concentrated in the lead car in the example illustrated in FIG. 4.

(2) The time required for the passengers to board and detrain from the cars varies from car to car when the passengers are concentrated at a particular place of the platform and in a particular car, as described above. In the illustrated example, the lead car requires the longest dwell time so that the operation control in line with the train schedule cannot be realized. As a result, the stopping time T1 of the preceding train becomes longer than the planned stopping time T1*n*.

(3) The operation is predicted up to the arrival of the succeeding train at the station A on the basis of the route database, the car database, and the location on the railroad of the preceding train.

FIG. 4 illustrates the example in which passengers planning to board the succeeding train are waiting on the platform of the station A, where the number of the passengers on the platform is assumed to be 20 people, 20 people, 20 people, and 20 people in order from the lead car in the case where the succeeding train is a train made up of four cars.

Moreover, the number of passengers in the cars of the succeeding train arriving at the station A is assumed to be 50 people, 50 people, 50 people, and 30 people in order from the lead car. One can see in the example of FIG. 4 that the passengers in the cars of the succeeding train are not concentrated to the extent of the preceding train.

(4) Time T2 is used as the planned stopping time of the succeeding train arriving at the station A.

(5) The operation of the succeeding train having been stopped for the planned stopping time T2 is predicted.

(6) However, due to the increase in the stopping time of the preceding train, the succeeding train is stopped at a stopping limit before the station B. The stopping limit of movement authority is determined by adding a certain allowance distance to the starting edge of the platform of the station B.

(7) The stopping limit is updated as the preceding train departs from the station B, so that the succeeding train starts traveling again and enters the platform of the station B.

In FIG. 5, the train operation control system performs the following operation. FIG. 5 illustrates a time difference T3 between the planned arrival time of the succeeding train and actual arrival of the succeeding train at the platform.

The operations (1) to (3) in FIG. 5 are similar to the operations (1) to (3) in FIG. 4, and thus will not be described.

(4) The train operation control system generates the stopping time T4 instead of the planned stopping time T2 as the stopping time of the succeeding train at the station A.

(5) The operation of the succeeding train stopped for the stopping time T4 is predicted.

(6) As a result of the operation prediction, the succeeding train can enter the station B without stopping before the platform track of the station B and can stop at the station B, as illustrated in FIG. 5. By virtue of this, the succeeding train can arrive at the station B earlier by a time T5 than when departing from the station A after stopping at the station for the planned stopping time T2. As a result, the train rescheduling device generates a time T4 as the stopping time of the succeeding train at the station A.

Figure 6:
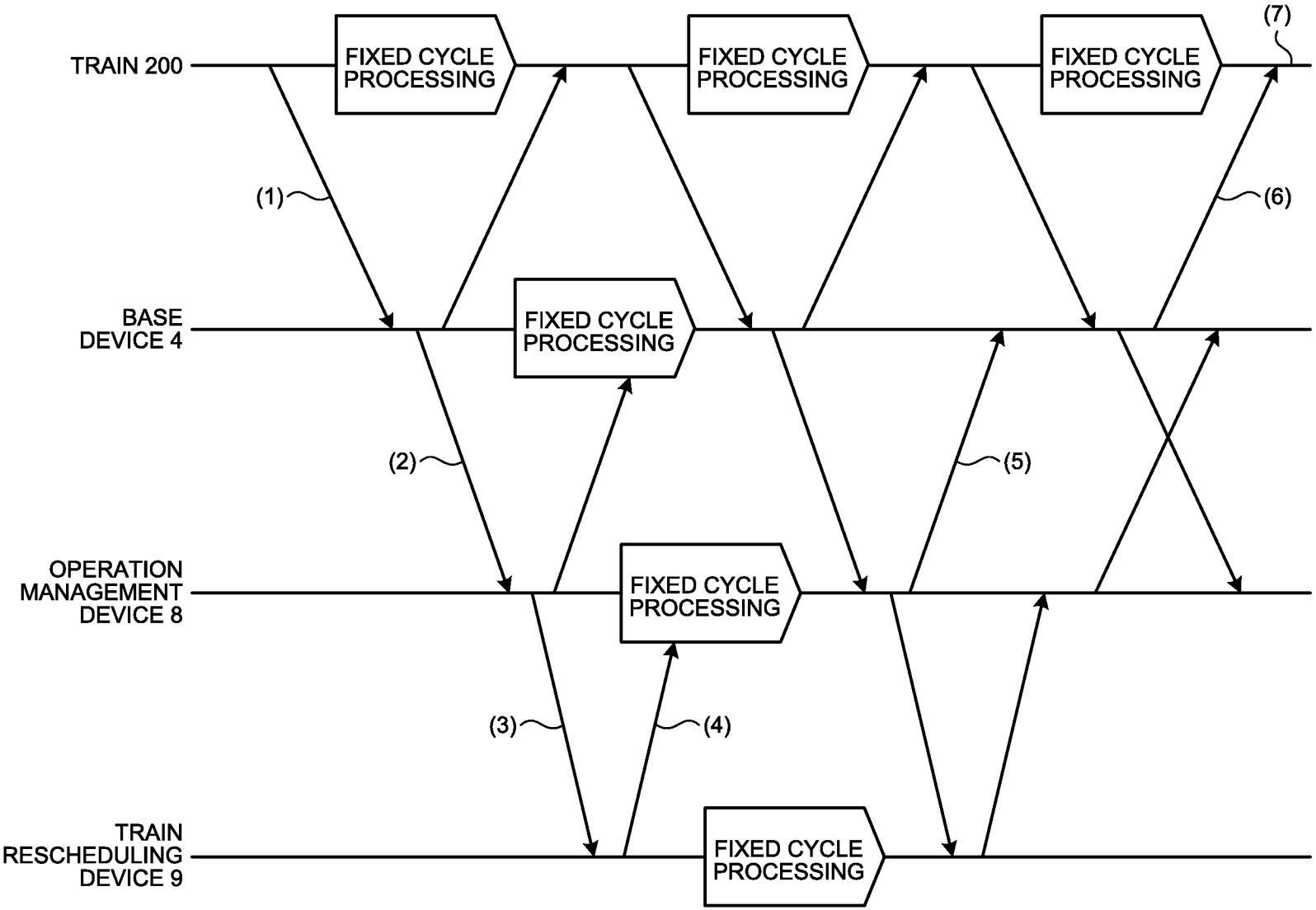
FIG. 6 is a timing chart illustrating information transmitted among the train, a base device, an operation management device, and a train rescheduling device illustrated in FIG. 2.

FIG. 6 is a timing chart illustrating information transmitted among the train, the base device, the operation management device, and the train rescheduling device illustrated in FIG. 2.

(1) The train 200 performs calculation of the estimated headcount, calculation of the train location, and transmission of the estimated headcount information and the train location information calculated to the base device 4 as fixed cycle processing.

(2) The base device 4 performs reception of the estimated headcount information, train tracking processing, calculation of the stopping limit, and transmission of the estimated headcount information to the operation management device 8 as fixed cycle processing. The base device 4 further transmits the train location information to the operation management device 8 for the fixed cycle processing.

(3) The operation management device 8 performs reception of the estimated headcount information, the train tracking processing, and course control as fixed cycle processing. The operation management device 8 further transmits a result of the train tracking processing, the schedule information, and the stopping time at a station to the train rescheduling device 9 for the fixed cycle processing.

(4) The train rescheduling device 9 performs prediction of the operation of a train traveling between stations, prediction of the required dwell time using the estimated headcount information, prediction of the stopping time of a train at a station, determination of a delay, and generation of an alternative as fixed cycle processing. When generating the alternative, the train rescheduling device 9 transmits information indicating the details of the generation to the operation management device 8.

(5) The operation management device 8 having received the information indicating the details of the generation generates a departure inhibiting command and transmits the command to the base device 4.

(6) The base device 4 having received the departure inhibiting command transmits it to the train 200.

(7) In the train 200 having received the departure inhibiting command, the train is inhibited from leaving the station.

Figure 7:
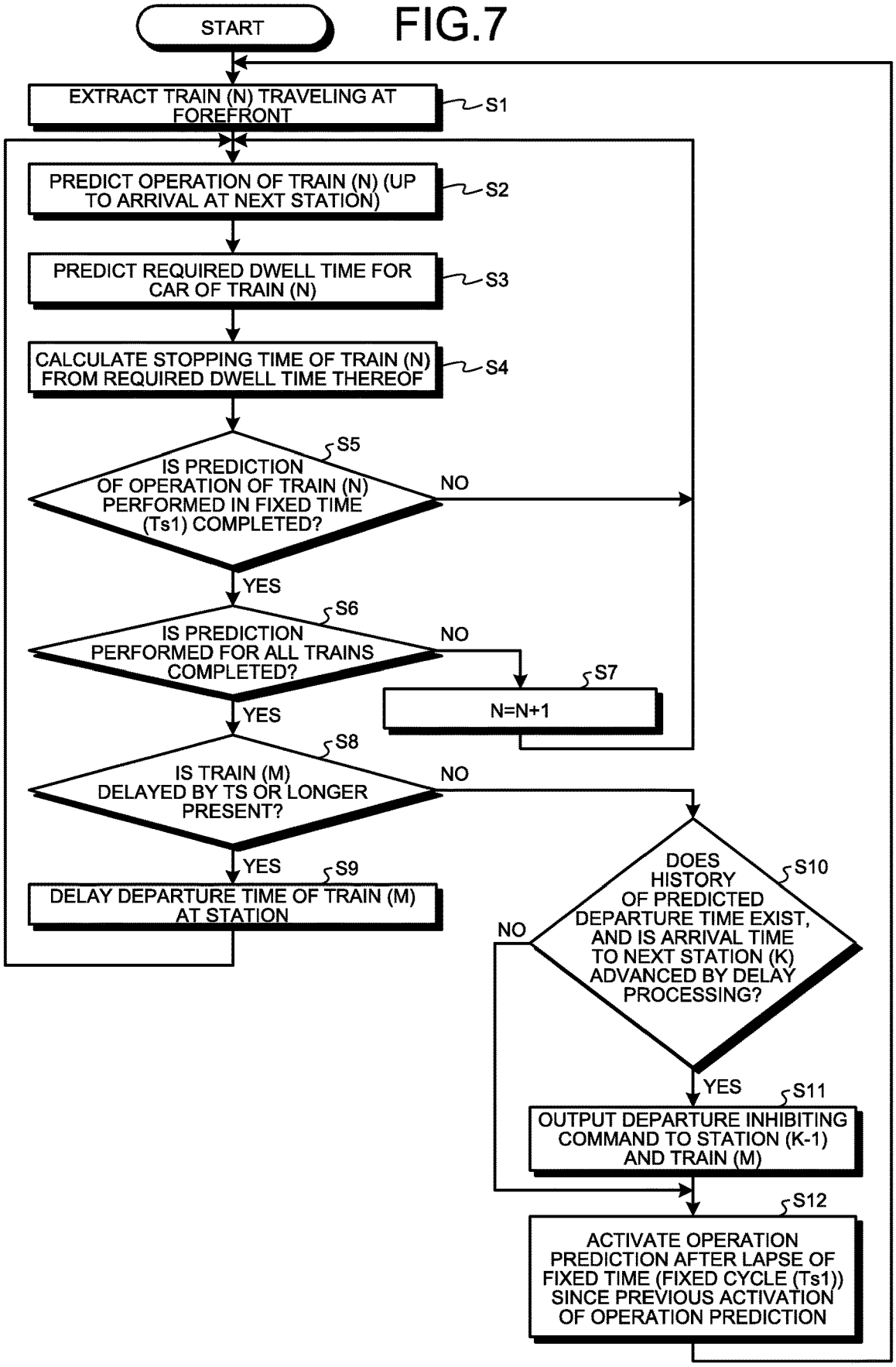
FIG. 7 is a flowchart for explaining the operation of the train operation control system illustrated in FIG. 2.

FIG. 7 is a flowchart for explaining the operation of the train operation control system illustrated in FIG. 2.

The train operation control system 100 recognizes the locations of a plurality of trains 200 present on each route and extracts a train (N) traveling at the forefront among the trains on the same route (S1).

The train operation control system 100 predicts the operation of the train (N) extracted until arrival at a next station (S2), and predicts the required dwell time for each car of the train (N) (S3).

The train operation control system 100 also calculates the stopping time of the train (N) from the required dwell time of the train (N) (S4).

The train operation control system 100 again performs the processing of S2 if the prediction of operation of the train (N) performed in a fixed cycle (Ts1) is not completed (No in S5).

The train operation control system 100 performs processing of S6 if the prediction of operation of the train (N) performed in the fixed cycle (Ts1) is completed (Yes in S5).

The train operation control system 100 determines whether or not the prediction of operation is completed for all the trains (S6).

If the prediction of operation of all the trains is not completed (No in S6), the train operation control system 100 adds one to the value of N (S7) and performs the processing of S2 again.

If the prediction of operation of all the trains is completed in S6 (Yes in S6), the train operation control system 100 determines the presence or absence of a train (M) which has been delayed by a threshold TS or longer (S8).

If the train (M) delayed by the threshold TS or longer is present (Yes in S8), the train operation control system 100 delays the departure time of the train (M) at the station (S9) and performs the processing of S2 again.

If the train (M) delayed by the threshold TS or longer is absent (No in S8), the train operation control system 100 determines whether or not a history of the predicted departure time exists and the arrival time to a next station (K) is advanced by delay processing (S10).

If the history of the predicted departure time exists and the arrival time to the next station (K) is advanced by the delay processing (Yes in S10), the train operation control system 100 outputs a departure inhibiting command to a corresponding station (K−1) (S11) and performs the processing of S12.

If the history of the predicted departure time exists and the arrival time to the next station (K) is not advanced by the delay processing (No in S10), the train operation control system 100 performs the processing of S12.

In S12, the operation prediction is activated after a lapse of the fixed cycle (Ts1) since the previous activation of the operation prediction.

Figure 8:
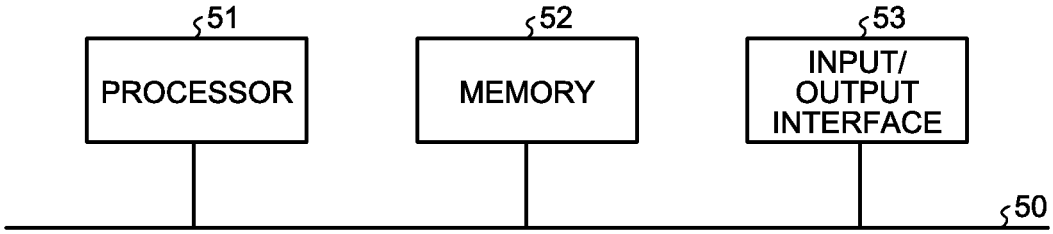
FIG. 8 is a diagram illustrating an example of the configuration of hardware for implementing a headcount estimation device, the operation management device, and the train rescheduling device illustrated in FIG. 1.

FIG. 8 is a diagram illustrating an example of the configuration of hardware for implementing the headcount estimation device, the operation management device, and the train rescheduling device illustrated in FIG. 1.

The headcount estimation devices 2 and 22, the operation management device 8, and the train rescheduling device 9 can be implemented by a processor 51, a memory 52 composed of a Random Access Memory (RAM) or a Read Only Memory (ROM), and an input/output interface 53 for connecting to a network. The processor 51, the memory 52, and the input/output interface 53 are connected to a bus 50 to be able to mutually exchange data, control information, and the like via the bus 50.

When the headcount estimation devices 2 and 22 are realized, a program for the headcount estimation devices 2 and 22 is stored in the memory 52 and executed by the processor 51 to thereby implement the headcount estimation units 2*a* and 22*a* of the headcount estimation devices 2 and 22. The input/output interface 53 is used when the headcount estimation devices 2 and 22 transmit location information.

When the operation management device 8 is realized, a program for the operation management device 8 is stored in the memory 52 and executed by the processor 51 to thereby implement the train tracking course control unit 8*a*, the inhibition command generation unit 8*c*, and the information transmission unit 8*d* of the operation management device 8. The schedule information database 8*e* and the stopping time database 8*f* are implemented by the memory 52. The input/output interface 53 is used when the train tracking course control unit 8*a* receives information from the information transmission unit 4*a* and the train tracking unit 4*b*. The input/output interface 53 is also used when the information transmission unit 8*d* transmits information.

When the train rescheduling device 9 is realized, a program for the train rescheduling device 9 is stored in the memory 52 and executed by the processor 51 to thereby implement the operation prediction unit 9*a*, the dwell time prediction unit 9*b*, the stopping time prediction unit 9*c*, the delay determination unit 9*d*, the information transmission unit 9*e*, the alternative generation unit 9*f*, the detraining passenger count database 9*g*, and the detraining passenger count estimation unit 9*h* of the train rescheduling device 9. The input/output interface 53 is used when the information transmitted from the information transmission unit 8*d* is received and when the detraining passenger count estimation unit 9*h* receives the automatic ticket gate data 10. The input/output interface 53 is also used when the operation prediction unit 9*a* reads the information in the schedule information database 8*e* and when the alternative generation unit 9*f* transmits information on the alternative to the operation management device 8.

Note that although the present embodiment has been given for description of the example that uses the estimated headcount information piece estimated using the video data obtained by the cameras installed in the car and the estimated headcount information piece estimated using the video data obtained by the cameras installed on the platform, the train operation control system 100 may be configured to generate the alternative by using either one of the estimated headcount information pieces.

For example, the headcount estimation device 22 outputs the estimated headcount information using the video data obtained by a camera installed for each of a number of doors installed in each car of the train, and the train rescheduling device 9 can use this information, thereby making it possible to roughly grasp the required dwell time even when any cameras are not installed on the platform.

Moreover, the headcount estimation device 2 outputs the estimated headcount information using the video data obtained by cameras installed on sides of both ends of the platform and on a center side of the platform, and the train rescheduling device 9 can use this information, thereby making it possible to roughly grasp the required dwell time even when any cameras are not installed in the car.

Furthermore, the train rescheduling device 9 can more accurately estimate the number of people in the car and on the platform by using the estimated headcount information estimated by both the headcount estimation devices 2 and 22, and thus can more accurately obtain the required dwell time.

The use of the cameras installed on the platform allows for real-time estimation of the number of people on the platform even when passengers are concentrated on a particular platform at the time of a big event held around a station or a disruption to the train schedule on another route, so that smooth operations of the trains can be realized by estimating the stopping time T1 of the train in question before a succeeding train arrives at a next station.

The use of the camera installed in the car allows for estimation of the number of people in the car with use of the number of people around a door as a reference in a case where many people are concentrated around the door, so that smooth operations of the trains can be realized by estimating the stopping time T1 of the train in question before a succeeding train arrives at a next station.

Although the present embodiment has been given for description of the example in which the headcount estimation device 22 is equipped on the train 200, the function of the headcount estimation device 22 may be incorporated in the headcount estimation device 2. In the case of such configuration, the video data obtained by the on-board cameras 23 is transmitted from the on-board radio device 20 to the ground radio device 6, and further transmitted to the headcount estimation device 2 via the ground transmission device 5 and the transmission interface unit 3. The headcount estimation device 2 uses the video data obtained on the train side and the video data obtained by the ground cameras 1 to estimate and output the number of people on both of the train side and the ground side.

As described above, the train operation control system according to the present embodiment includes: the headcount estimation device that estimates at least one of the number of people in the train and the number of people on the platform, using the video data outputted from a plurality of cameras; and the train rescheduling device that predicts the dwell time required for passengers to board and detrain from the train, using the estimated headcount information estimated by the headcount estimation device and the schedule information, so as to perform train rescheduling. By such a configuration, it is possible to recognize the numbers of boarding and detraining passengers at two or more points on the ground side or on the train side in real time.

The train operation control system of the present embodiment can also use these data pieces to predict the dwell time for each car and the stopping time derived from the dwell time, and predict the operation of the train in addition to prediction of the train travel. Accordingly, the dwell time can be predicted accurately even when the number of passengers drastically fluctuates, so that a change in the operation schedule of the train can be automatically generated in accordance with the prediction result satisfactorily.

Moreover, since the train operation control system of the present embodiment need not temporarily stop the succeeding train before the station, fluctuations in the train speed associated with stopping and re-power running are reduced, thereby not only improving the ride comfort but also reducing the energy consumed at the time of re-power running.

Moreover, the train operation control system of the present embodiment can perform real-time estimation of the number of people on the platform even when passengers are concentrated on a particular platform at the time of a big event held around the station or a disruption to the train schedule on another route, so that smooth operations of the trains can be realized based on estimation of the stopping time of the train concerned before a succeeding train arrives at a next station.

The conventional technique disclosed in Patent Literature 1 above cannot grasp the numbers of boarding and detraining passengers for each car of the train, and thus cannot predict an increase in the dwell time caused by concentration of passengers in a particular car. In contrast to this, the train operation control system of the present embodiment can predict an increase in the dwell time caused by concentration of passengers in a particular car, so that the smooth operations of the trains can be realized by predicting the stopping time of the train in real time even when the numbers of boarding and detraining passengers fluctuate in each car.

Moreover, the train rescheduling device of the present embodiment includes: the detraining passenger count database in which the information on the number of detraining passengers for each station; and the dwell time prediction unit that predicts the number of people detraining from the train on the basis of the detraining ratio for each station derived from the number of detraining passengers recorded in the detraining passenger count database and the number of passengers boarding the train, and predicts the dwell time using the predicted number of people detraining from the train. Such a configuration can improve the accuracy of estimating the number of detraining passengers for each station, which cannot be determined only using the number of passengers estimated using the cameras on the train side.

Moreover, the train rescheduling device of the present embodiment includes: the detraining passenger count estimation unit that estimates the number of detraining passengers for each car at the station on the basis of the automatic ticket gate data; and the dwell time prediction unit that predicts the dwell time using the number of detraining passengers estimated by the detraining passenger count estimation unit. Such a configuration allows for accurate prediction of the number of detraining passengers for each train on the basis of the data for each station, which is obtained in real time by the automatic ticket gate. The data is, for example, a piece of data on the number of detraining passengers and a time period during which the passengers pass through the ticket gate.

Moreover, according to the train operation control method of the present embodiment, the train rescheduling device includes: a headcount estimation step of estimating the number of people in a train and the number of people on a platform, using the video data outputted from the plurality of cameras mounted on the train and the video data outputted from the plurality of cameras installed for the platform; and a dwell time prediction step of predicting the dwell time required for passengers to board and detrain from the train, using the number of people estimated in the headcount estimation step and the schedule information. The train rescheduling device further includes: a stopping time prediction step of predicting the stopping time of the preceding train, using the dwell time estimated by the dwell time prediction step; and an alternative generation step of generating the alternative for inhibiting departure of the succeeding train on the basis of the stopping time predicted by the stopping time prediction step. Therefore, the use of the existing train rescheduling device allows for accurate prediction of the dwell time of the passengers to accordingly making it possible to automatically generate a change in the operation schedule of the trains in accordance with the prediction result.

The configuration described in the above embodiment merely illustrates an example of the content of the present invention, and can thus be combined with other publicly known techniques and partially omitted and/or modified without departing from the scope of the present invention.

REFERENCE SIGNS LIST

1 ground camera; 2 headcount estimation device; 3 transmission interface unit; 4 base device; 4*a* information transmission unit; 4*b* train tracking unit; 4*c* coordination processing unit; 4*d* input/output unit; 5 ground transmission device; 6 ground radio device; 7, 7*a* transmission line; 8 operation management device; 8*a* train tracking course control unit; 8*c* inhibition command generation unit; 8*d* information transmission unit; 8*e* schedule information database; 8*f* stopping time database; 9 train rescheduling device; 9*a* operation prediction unit; 9*b* dwell time prediction unit; 9*c* stopping time prediction unit; 9*d* delay determination unit; 9*e* information transmission unit; 9*f* alternative generation unit; 9*g* detraining passenger count database; 9*h* detraining passenger count estimation unit; 10 automatic ticket gate data; 11 railroad signal; 12 track circuit; 13 railroad switch; 20 on-board radio device; 21 on-board transmission device; 22 headcount estimation device; 22*a* headcount estimation unit; 23 on-board camera; 30 platform; 31 transmission line; 50 bus; 51 processor; 52 memory; 53 input/output interface; 100 train operation control system; 200 train.

The invention claimed is:

1. A train operation control system comprising:

a headcount estimation device to estimate at least one of the number of people in each car of a train and the number of people on a platform of a station for each car of the train, using video data outputted from a plurality of cameras; and a train rescheduling device to predict a plurality of dwell times including a dwell time for each car of the train at a first station, using the estimated headcount information estimated by the headcount estimation device and schedule information, determine a longest dwell time of the plurality of dwell times, and accordingly perform train rescheduling on a succeeding train behind the train at a second station that is situated before the first station based on the longest dwell time.

2. The train operation control system according to claim 1, wherein the train rescheduling device generates a new stopping time for the succeeding train at the second station.

3. The train operation control system according to claim 2, wherein the train rescheduling device includes:

a detraining passenger count database in which information on the number of detraining passengers for each station is recorded; and a dwell time prediction unit to predict the number of people detraining from the train on the basis of a detraining ratio for each station derived from the number of detraining passengers recorded in the detraining passenger count database and the number of passengers boarding the train, and predict the dwell time using the predicted number of people detraining from the train.

4. The train operation control system according to claim 2, wherein the train rescheduling device includes:

a detraining passenger count estimation unit to estimate the number of detraining passengers for each car at a station on the basis of automatic ticket gate data; and a dwell time prediction unit to predict the dwell time using the number of detraining passengers estimated by the detraining passenger count estimation unit.

5. The train operation control system according to claim 1, wherein the train rescheduling device includes:

a detraining passenger count database in which information on the number of detraining passengers for each station is recorded; and a dwell time prediction unit to predict the number of people detraining from the train on the basis of a detraining ratio for each station derived from the number of detraining passengers recorded in the detraining passenger count database and the number of passengers boarding the train, and predict the dwell time using the predicted number of people detraining from the train.

6. The train operation control system according to claim 1, wherein the train rescheduling device includes:

a detraining passenger count estimation unit to estimate the number of detraining passengers for each car at a station on the basis of automatic ticket gate data; and a dwell time prediction unit to predict the dwell time using the number of detraining passengers estimated by the detraining passenger count estimation unit.

7. A train operation control method applied to a train operation control system including an operation management device to manage an operation of a train and a train rescheduling device to perform train operation rescheduling of the train, wherein the train rescheduling device comprises:

a headcount estimation step of estimating the number of people in each car of the train and the number of people on a platform of a station for each car of the train, using video data outputted from a plurality of cameras mounted on the train and video data outputted from a plurality of cameras installed for the platform;

a dwell time prediction step of predicting a plurality of dwell times including a dwell time required for passengers to board and detrain from each car of the train, using the number of people estimated in the headcount estimation step and schedule information;

a stopping time prediction step of predicting a stopping time of a preceding train at a first station, using a longest dwell time of the plurality of dwell times estimated in the dwell time prediction step; and an alternative generation step of generating an alternative for inhibiting departure of a succeeding train behind the train at a second station that is situated before the first station on the basis of the stopping time predicted in the stopping time prediction step.

* * * * *